US006074278A

United States Patent [19]

Wu et al.

[11] Patent Number: 6,074,278

[45] Date of Patent: Jun. 13, 2000

[54] HIGH SPEED GRINDING WHEEL

[75] Inventors: Mianxue Wu; Lee A. Carman, both of Worcester, Mass.; Lars Aspensjö , Bonn, Germany

[73] Assignee: Norton Company, Worcester, Mass.

[21] Appl. No.: 09/016,823

[22] Filed: Jan. 30, 1998

[51] Int. Cl.[7] ..... B24B 1/00

[52] U.S. Cl. ..... 451/28; 451/541; 451/527; 451/529

[58] Field of Search ..... 451/541, 527, 451/529, 28

[56] References Cited

U.S. PATENT DOCUMENTS

| | | | |
|---|---|---|---|
| 4,898,597 | 2/1990 | Hay et al. . | |
| 5,129,919 | 7/1992 | Kalinowski et al. | 51/309 |
| 5,498,269 | 3/1996 | Larmie | 51/295 |
| 5,527,369 | 6/1996 | Garg . | |
| 5,573,561 | 11/1996 | Sheldon et al. . | |
| 5,651,729 | 7/1997 | Benguerel | 451/541 |

FOREIGN PATENT DOCUMENTS

| | | | |
|---|---|---|---|
| 58-34431 | 7/1983 | Japan | B24D 3/14 |
| 3-224474 | 10/1991 | Japan | B24D 5/04 |
| 3-234474 | 10/1991 | Japan | B24D 5/04 |

*Primary Examiner*—David A. Scherbel
*Assistant Examiner*—Shantese McDonald
*Attorney, Agent, or Firm*—Mary E. Porter

[57] ABSTRACT

A method of obtaining superabrasive grinding performance from tools employing less expensive, non-superabrasive conventional abrasive grain involves operating the conventional abrasive tool at ultra high tangential contact speed, (that is at least about 125 m/s). Such ultra high operating speeds can be achieved with segmented abrasive grinding wheels having segments formed from vitreous or resin bonded particles of aluminum oxide, silicon oxide, iron oxide, molybdenum oxide, vanadium oxide, tungsten carbide, silicon carbide and the like. The abrasive segments can be cemented to the core of the tool with an adhesive such as epoxy cement. Abrasive segments can be made to a significantly greater depth than traditional superabrasive-bearing segments, and consequently, should provide long life as well as high performance. Additionally, conventional abrasive segments are easier to true and dress and to make into intricate profiles for grinding complex shaped work pieces.

19 Claims, 1 Drawing Sheet

HIGH SPEED GRINDING WHEEL

FIELD OF THE INVENTION

This invention relates to grinding tools for use at high surface operating speed. More specifically, the invention pertains to a conventional abrasive segmented grinding wheel which can be operated at high speed to achieve grinding performance approaching that of superabrasive grinding wheels.

BACKGROUND AND SUMMARY OF THE INVENTION

Grinding tools, and especially wheels have significant commercial applicability to operations such as cutting, shaping and polishing industrial materials. These wheels generally comprise abrasive grain held together by a bonding material in a disk structure. Usually a central bore through the wheel accepts a power driven shaft that permits the wheel to rotate with the abrasive surface in operative contact against a work piece.

The abrasive material is, of course, an important parameter that determines performance of a grinding tool. The art now recognizes at least two broad categories of industrial grain materials, namely "superabrasives" and "conventional abrasives". The former are ultra hard materials which are able to abrade the hardest, and therefore, the most difficult to cut work pieces. The most well known superabrasives are diamond and cubic boron nitride ("CBN"). Conventional abrasives are abrasives which are not as hard as superabrasives and thus find general purpose utility in a wide variety of normally less demanding grinding applications.

Conventional abrasive grinding wheel construction has developed differently from that of superabrasive wheels. Conventional abrasive wheels are generally characterized by a single region of abrasive grain embedded in a bond. That is, the abrasive region extends from the bore outward to the periphery of the wheel. In contrast, superabrasive wheels usually include a core, often of metal, which extends from the bore outward to a cutting surface. The superabrasive is affixed to the circumference of the cutting surface, either as a single layer bonded to the metal core or as a multi-layer, but shallow depth continuous or segmented rim of grain embedded in a bond. The rim, whether continuous or segmented, is fastened to the metal core. The metal core frequently constitutes the major fraction of the solid volume occupied by the wheel, and thus obviates having to fill the wheel from bore to periphery with superabrasive grain and bond. In effect, the core significantly reduces the cost of a superabrasive tool by placing the abrasive grain only at the cutting surface.

Provided that all operating variables are the same, superabrasives usually outperform conventional abrasives in a given grinding application. That is, such performance parameters as speed of removing the work; service life, i.e., volume of work removed per unit of abrasive removed; amount of force needed to push the tool into the work; and power necessary to cut a given hardness work piece, are usually better for superabrasives than conventional abrasives. Hence, it is theoretically desirable to employ superabrasive tools universally. Unfortunately, the cost of superabrasive is typically multiple orders of magnitude higher than conventional abrasive. Consequently, tools of superabrasive grain normally are selected only for jobs in which the work piece material is difficult for conventional abrasive and for jobs demanding very high performance.

In addition to high cost, superabrasive wheels have certain other undesirable characteristics. Significant among these is that the wheel is difficult to dress by virtue of the intrinsically ultra hard nature of superabrasive. This affects wheel manufacture and use in several ways. For example, in wheel fabrication, the fully assembled tool must be "trued" to precisely shape the cutting surface to design tolerances. In operation, the wheel must be periodically dressed to rejuvenate dulled cutting surfaces. Truing and dressing are normally performed by running the wheel against another precisely shaped abrasive material. These operations are slow and difficult because the hardness of the superabrasive is on par with that of the shaped material. It is also difficult to create superabrasive tools with intricately contoured cutting surfaces because the tools necessary to true and dress such contoured tools are not generally available.

It is very desirable to obtain grinding performance from a conventional abrasive grinding wheel that approaches the performance of a superabrasive wheel in appropriate applications, i.e., for cutting a work piece within the hardness range of conventional abrasive capability. It has been discovered that such "near superabrasive performance" can be achieved by operating certain conventional abrasive grinding wheels in ultra high speed mode. That is, the tangential contact speed of the conventional abrasive segment relative to the work piece should be at least about 125 m/s. The stress of operation at such ultra high speeds will cause many wheels, especially traditional conventional abrasive wheels, to rupture and disintegrate. Thus it is important that the conventional abrasive wheel operated in accordance with the present invention be fabricated in such a manner as to possess minimum core strength and rim strength parameters, described in greater detail, below.

Accordingly, there is now provided by the present invention a method of grinding a hard material comprising:

providing a grinding tool consisting essentially of
- a core having a core strength parameter of at least 60 MPa-cm$^3$/g;
  - an abrasive segment affixed to the circumference of the core, wherein the abrasive segment comprises conventional abrasive grains embedded in a bond having a rim strength parameter of at least 10 MPa-cm$^3$/g; and
- a cement between the abrasive segment and the core; and moving the abrasive segment at a tangential contact speed of at least about 125 m/sec in contact with the hard material.

There is further provided a method of making a grinding tool having an abrasive segment comprising a conventional abrasive and a vitrified bond, in which the grinding tool is adapted to engage a work piece at a tangential contact speed of at least 125 m/s.

DETAILED DESCRIPTION

Figure 1:
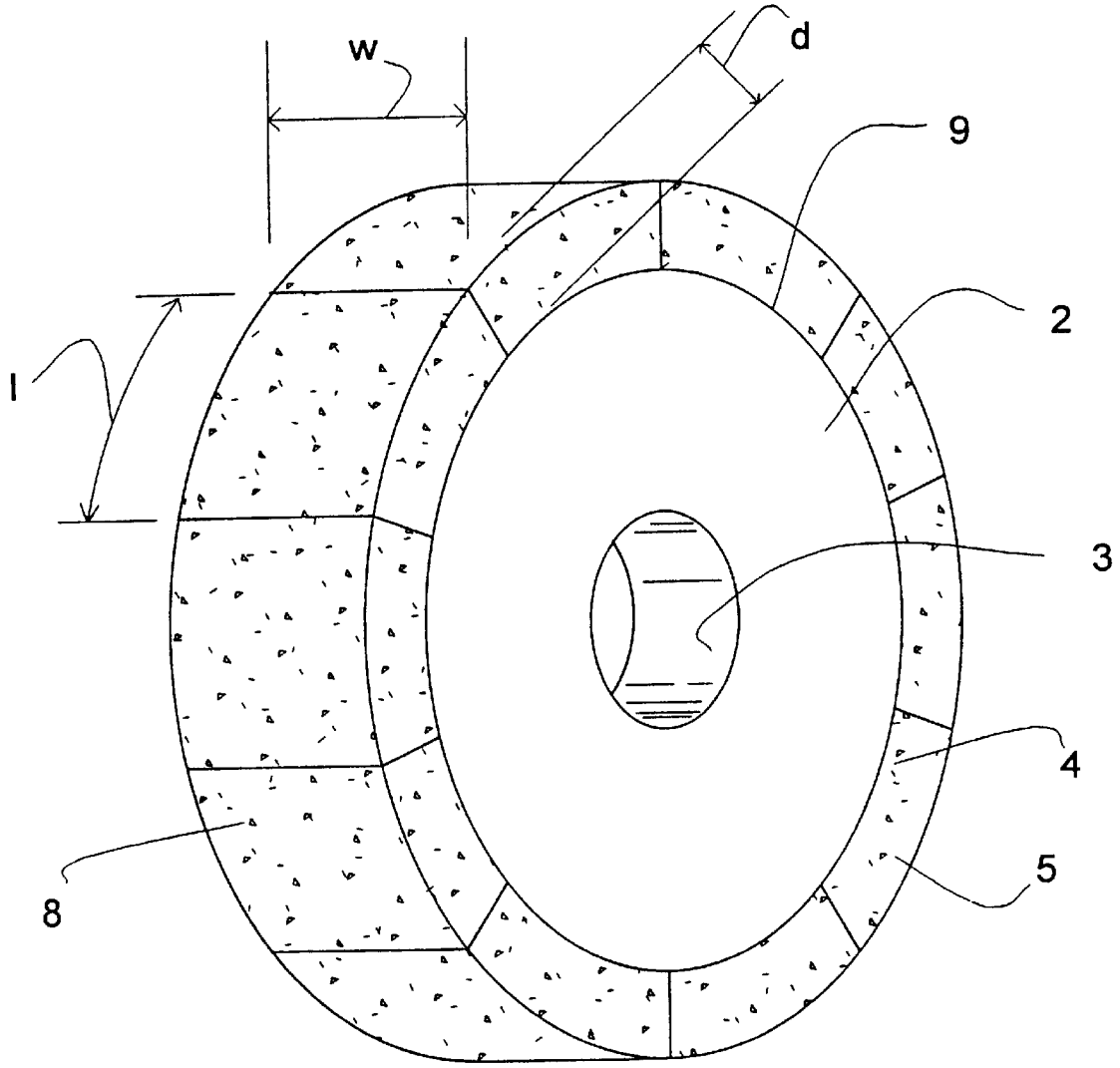
FIG. 1 is a perspective view of a segmented abrasive grinding wheel according to this invention.

This invention basically involves the discovery that abrasive tools with conventional abrasive grain can achieve the grinding performance of superabrasive-bearing tools when operated at ultra high tangential contact speed. The term "tangential contact speed" means the relative rate of motion in the direction tangential to the grinding action between the abrasive tool and the work piece. For example, the tangential contact speed of a continuous abrasive band saw blade cutting a stationary block of work would be the linear speed of the blade in the direction of cut. Similarly, the tangential contact speed of an oscillating saw blade cutting a motionless block would be the linear speed of the blade in the direction of oscillation, observing that the blade speed necessarily decelerates to zero and re-accelerates instantaneously at the end of each stroke as the blade reverses direction.

For an abrasive wheel, the tangential contact speed is the linear speed of the cutting surface which is usually at the rotating wheel periphery. Tangential contact speed takes into account movement of the workpiece relative to the cutting blade. Thus the longitudinal feed movement of the surface of a work piece past a fixed position, rotating abrasive wheel contributes to the tangential contact speed. However, the tool speed contribution of the ultra high tangential contact speed abrasive tools according to this invention is generally disproportionately large compared to the longitudinal movement element. Normally, the longitudinal movement can be neglected. That is, the tangential contact speed of an ultra high rotation speed abrasive wheel in most practical situations is effectively equal to the wheel cutting surface speed due to rotation. For example, the tangential contact speed of a 30 cm diameter wheel rotating at about 9,550 rev./min. is 150 m/s. The longitudinal feed movement of a work piece past this wheel typically is less than 1m/s.

According to the present invention, superior grinding performance from conventional abrasives is obtained at tangential contact speed above about 125 m/s. The upper speed limit is not critical from a grinding performance standpoint. Generally, the higher the speed the better grinding performance that is obtained. However, practical considerations such as the burst strength of the tool and excessive heat build-up become significant as speed increases. Based on the limitations of presently available materials of construction, tangential contact speed preferably should be in the range of about 150–200 m/s.

The novel method can be applied to any type of abrasive tool, such as drill bits and rotary saw blades, in addition to the tool types already mentioned. Manual power generally cannot sustain the ultra high tangential contact speed that engenders superior grinding performance. For most practical applications, the tool and/or the work piece should be power driven, and accordingly, should be structurally strong enough to withstand the stress of automated operation. Hence, it is contemplated that preferred tools for practicing this invention should have an abrasive segment supported by a reinforced core.

The tool should be strong, durable and dimensionally stable in order to withstand the potentially destructive forces generated by high speed operation. The core should have a high core strength parameter, which is especially important for grinding wheels operated at very high angular velocity to achieve tangential contact speed above 125 m/s. The minimum core strength parameter preferred for the core for use in this invention should be about 60M Pa-cm$^3$/g. The core strength parameter is defined as the ratio of core material tensile strength divided by core material density. The tensile strength of a material is the minimum force applied in tension for which strain of the material increases without further increase of force. For example, ANSI 4140 steel hardened to above about 240 (Brinell scale) has a tensile strength in excess of 700 MPa. Density of this steel is about 7.8 g/cm$^3$. Thus, its core strength parameter is greater than about 90 MPa-cm$^3$/g. Similarly, certain aluminum alloys, for example, Al 2024, Al 7075 and Al 7178, that are heat treatable to Brinell hardness above about 100 have tensile strengths higher than about 300 MPa. Such aluminum alloys have low density of about 2.7 g/cm$^3$ and thus exhibit a core strength parameter of more than 110 MPa-cm$^3$/g. Titanium alloys are also suitable for use.

The core material also should be ductile, thermally stable at temperatures reached in the grinding zone, resistant to chemical reaction with coolants and lubricants used in grinding and resistant to wear by erosion due to motion of cutting debris in the grinding zone. Although some alumina and other ceramics yield at higher than 60 MPa-cm$^3$/g, they generally are brittle and fail structurally as a core in high speed grinding due to fracture. Hence, ceramics are not recommended for a high speed grinding tool core. Metal, especially hardened, tool quality steel, is preferred.

Preferably, the abrasive segment of the grinding wheel for use with the present invention is a segmented or continuous rim mounted on a core. A segmented abrasive rim is shown in FIG. 1. The core 2 has a central bore 3 for mounting the wheel to an arbor of a power drive, not shown. The abrasive rim of the wheel comprises conventional abrasive grains 4 embedded in uniform concentration in a matrix of a bond 6. A plurality of abrasive segments 8 make up the abrasive rim. Although the illustrated embodiment shows ten segments, the number of segments is not critical.

Broadly described, an individual abrasive segment has a truncated, rectangular ring shape characterized by a length, l, a width, w, and a depth, d. The wheel can be fabricated by first forming individual segments of preselected dimension and then attaching the pre-formed segments to the circumference 9 of the core with an appropriate adhesive. Another preferred fabrication method involves forming segment precursor units of a mixture of abrasive grain and bond composition around the core and applying heat and pressure to create and attach the segments, in situ.

The embodiment of a grinding wheel shown in FIG. 1 is considered representative of wheels which may be operated successfully according to the present invention, and should not be viewed as limiting. The numerous geometric variations for segmented grinding wheels deemed suitable include cup-shaped wheels, wheels with apertures through the core and/or between consecutive segments, and wheels with abrasive segments of different width than the core. Apertures are sometimes used to provide paths to conduct coolant to the grinding zone and to route cutting debris away from the zone. A wider segment than the core width is occasionally employed to protect the core structure from erosion through contact with swarf material as the wheel radially penetrates the work piece.

A basic defining criterion of any abrasive is that the abrasive substance be harder than the substance to be ground. Subject to this limitation, the conventional abrasive of this invention can be any abrasive other than a superabrasive as recognized in the grinding art. Thus conventional abrasive can include an extremely wide variety of materials, depending upon the hardness of the work piece in any particular grinding application. The conventional abrasive of this invention thus can include moderately hard, usually inorganic mineral compositions, such as corundum, emery, flint, garnet, pumice, alumina, and silica, and can encompass even very hard metal alloys such as carbides of tungsten, silicon, and molybdenum as well as various mixtures of more than one such material to name just a few examples. Preferred conventional abrasives include aluminum oxide (e.g., fused alumina and sintered alumina, including seeded and unseeded sol gel sintered alumina), silicon oxide, iron oxide, molybdenum oxide, vanadium oxide, tungsten carbide, silicon carbide, and mixtures of some or all of them.

Sol gel alumina is a preferred conventional abrasive grain suitable for use in the present invention. "Sol gel alumina" means sintered sol-gel alumina in which crystals of alpha alumina are of a basically uniform size which is generally smaller than about 10 $\mu$m, and more preferably less than about 5 $\mu$m, and most preferably less than about 1 $\mu$m in diameter. The sol gel alumina grain useful herein may be produced by a seeded or an unseeded sol gel process.

Sol-gel alumina abrasives are conventionally produced by drying a sol or gel of an alpha alumina precursor which is usually but not essentially, boehmite; forming the dried gel into particles of the desired size and shape; then firing the pieces to a temperature sufficiently high to convert them to the alpha alumina form. The alpha alumina gel can be sintered to adjust porosity and the particles may be further broken, screened and sized to form polycrystalline grains of alpha alumina microcrystals. Simple sol-gel processes for making grain suitable for use in accordance with the present invention are described, for example, in U.S. Pat. Nos. 4,314,827; 4,518,397 and 5,132,789; and British Patent Application 2,099,012, the disclosures of which are incorporated herein by reference.

In one form of sol-gel process, the alpha alumina precursor is "seeded" with a material having the same crystal structure as, and lattice parameters as close as possible to, those of alpha alumina itself. The amount of seed material should not exceed about 10 weight % of the hydrated alumina and there is normally no benefit to amounts in excess of about 5 weight %. If the seed is adequately fine (a surface area of about 60 $m^2$ per gram or more), preferably amounts of from about 0.5 to 10 weight %, more preferably about 1 to 5 weight %, may be used. The seeds may also be added in the form of a precursor which converts to the active seed form at a temperature below that at which alpha alumina is formed. The function of the seed is to cause the transformation to the alpha form to occur uniformly throughout the precursor at a much lower temperature than is needed in the absence of the seed. This process produces a microcrystalline structure in which the individual crystals of alpha alumina are very uniform in size and are preferably all sub-micron in diameter. Suitable seeds include alpha alumina itself but also other compounds such as alpha ferric oxide, chromium suboxide, nickel titanate and a plurality of other compounds that have lattice parameters sufficiently similar to those of alpha alumina to be effective to cause the generation of alpha alumina from a precursor at a temperature below that at which the conversion normally occurs in the absence of such seed.

Examples of sol gel processes for making abrasive grain suitable for use in the invention include, but are not limited to, those described in U.S. Pat. Nos. 4,623,364; 4,744,802; 4,788,167; 4,881,971; 4,954,462; 4,964,883; 5,192,339; 5,215,551; 5,219,806; and 5,453,104, the disclosures of which are incorporated herein by reference.

Sol gel alumina abrasive grains can be of many shapes, such as blocky and filamentary grains. Filamentary grains, occasionally referred to herein as elongated or "TG" have a high aspect ratio defined as the quotient of a long characteristic dimension divided by an appreciably smaller short characteristic dimension. The aspect ratio of filamentary seeded sol-gel alumina particles in the mixture is at least about 3: 1, and preferably at least about 4:1. Such filamentary seeded sol-gel alumina grains are disclosed in U.S. Pat. Nos. 5,194,072 and 5,201,916, which are incorporated herein by reference. Blocky sol gel alumina grains, occasionally referred to herein as "SG" material, generally have a granular appearance and have an aspect ratio of about 1:1. Particular preference is given to use of an abrasive grain comprising a mixture of blocky and filamentary sol-gel alumina grains. In the binary mixture, preferably about 40–60 wt % of the particles is elongated and a complementary amount is blocky, and more preferably, elongated and blocky particles are about equal weight fractions.

Many modifications of sintered sol gel alumina abrasive grain have been reported. All polycrystalline abrasive grain within the class is defined by the grain comprising at least 60% alpha aluminum crystals having a density of at least about 95% of theoretical density, crystal size less than about 10 $\mu$m, and preferably uniform microcrystals less than 1 $\mu$m or uniform crystals about 1–5 $\mu$m, and a Vickers hardness of greater than about 16 GPa, preferably 18 GPa at 500 grams are suitable for use in this invention.

In making unseeded sol gel alumina grain, modifiers are often used to influence crystal size and other material properties. Typical modifiers may include up to 15 wt % of spinel, mullite, manganese dioxide, titania, magnesia, rare earth metal oxide, zirconia or zirconia precursor (which can be added in larger amounts, e.g., about 40 wt % or more). The modifier is included in the initial sol as disclosed in the above-mentioned U.S. Pat. Nos. 4,314,827, 5,192,339 and 5,215,551. Further modifications involve inclusion of various amounts of modifiers, for example, yttria, oxides of rare earth metals, such as lanthanum, praseodymium, neodymium, samarium, gadolinium, erbium, ytterbium, dysprosium and cerium, transition metal oxides and lithium oxide as disclosed in U.S. Pat. Nos. 5,527,369, and 5,593,468 incorporated herein by reference. These modifiers are often included to alter such properties as fracture toughness, hardness, friability, fracture mechanics, or drying behavior.

In another aspect of this invention, it is contemplated to use a combination abrasive material which comprises a conventional abrasive component and a superabrasive component. The grinding capability enhancement obtained by ultra high speed grinding is of such magnitude that a substantial portion of superabrasive grain can be replaced by conventional abrasive without sacrifice of performance. The present invention thus provides a technique for obtaining from an abrasive segment having a minor fraction (<50%) of superabrasive grain, the grinding rate and tool life close to that expected from tools of 100% superabrasive. Preferably, the conventional abrasive component constitutes a major fraction (>50%) of the total abrasive in the abrasive segment, and more preferably, at least about 80% of total abrasive. The conventional abrasive and superabrasive components can be mixed uniformly throughout the abrasive segment. They also can be segregated in distinct regions of the abrasive segment or combinations of mixed and segregated regions can be incorporated in a single tool.

The abrasive segment should be constructed to provide structural integrity able to withstand rupture and disintegration when the tool is operated at ultra high tangential contact speed, i.e., above 125 m/s. Accordingly, the abrasive segment should exhibit a minimum rim strength parameter defined as the tensile strength divided by the density of the conventional abrasive. In view of the fact that the stresses operating on the abrasive segment of a grinding wheel are reduced at the periphery relative to the center of the wheel, the minimum rim strength parameter of the abrasive segment for use according to this invention can be less than the core strength parameter of the core. Preferably, the rim strength parameter should be at least about 10 MPa-$cm^3$/g.

The composition for the bond material can be any of the general types common in the art. For example, glass or vitrified, resinoid, or metal may be used effectively, as well as hybrid bond material such as metal filled resinoid bond material and resin impregnated vitrified bond. A vitrified bond is preferred.

Resinoid bond can be used provided, of course, that the bond has sufficient strength and heat resistance. Any of the well-known cross linked polymers such as phenol-aldehyde, melamine-aldehyde, urea-aldehyde, polyester, polyimide, and epoxy polymers can be employed. Resinoid bond can include fillers such as cryolite, iron sulfide, calcium fluoride, zinc fluoride, ammonium chloride, copolymers of vinyl chloride and vinylidene chloride, polytetrafluoroethylene, potassium fluoroborate, potassium sulfate, zinc chloride, kyanite, mullite, graphite, molybdenum sulfide, and mixtures of these.

Any of the well-known vitrified bonds may be used. For conventional abrasive wheels containing sol gel alumina grain, it has been found important to use vitrified bonds that can be fired at relatively low temperatures. In context of firing of vitrified bonds, low temperature firing is understood to be no greater than about 1100° C. Firing temperatures are preferably less than about 1000° C. Vitrified bonds generally comprise fused metal oxides such as oxides of silicon, aluminum, iron, titanium, calcium, magnesium, sodium, potassium, lithium, boron, manganese and phosphorous and typically incorporate mixtures of oxides of these metals. Representative metal oxides for inclusion in a vitrified bond are $SiO_2$, $Al_2O_3$, $Fe_2O_3$, $TiO_2$, CaO, MgO, $Na_2O$, $K_2O$, $Li_2O$, $B_2O_3$, $MnO_2$, and $P_2O_5$. The vitrified bond can be effected by employing the metal oxide components in fine particulate form. If multiple metal oxides are included, the particles should be mixed to uniformity. Advantage may result by making a frit from the raw components of the vitrified bond composition, grinding the frit to a powder and using the frit to bond the abrasive grain. A frit can be obtained by prefiring the composition raw precursors of the metal oxide components at a temperature and for a duration effective to form a homogeneous glass. Temperatures in the range of about 1100° C.–1800° C. are typical.

The abrasive segment of the wheel can be formed by blending fine particles of abrasive grain and bond composition components to form a dry mixture. Blending is continued until a uniform concentration of abrasive and bond is obtained. Alternatively, a wet blend can be formed by incorporating an optional, fugitive liquid vehicle with the dry particles. The term "fugitive" means that the liquid vehicle leaves the blend when the bond is formed by curing as explained below. The vehicle is a typically moderate to high-boiling, organic liquid capable of mixing with the dry particle components to form a viscous paste. The liquid facilitates preparation of a uniform bond and abrasive network and further helps to dispense the bond and abrasive composition during the segment-forming process. Examples of fugitive liquid vehicle materials suitable for use with this invention include—water, animal glue, aliphatic alcohols, glycols, oligomeric glycols, ethers and esters of such glycols and oligomeric glycols and waxy or oily high molecular weight petroleum fractions such as, mineral oil and petrolatum. Representative alcohols include isopropanol and n-butanol. Representative glycols and oligomeric glycols include ethylene glycol, propylene glycol, 1,4-butanediol, diethylene glycol, and diethylene glycol monobutylether.

Porosity forming agents and other additives optionally can be added to the abrasive segment mixture. Representative porosity forming agents and other additives include hollow ceramic spheres (e.g., bubble alumina) and particles of graphite, silver, nickel, copper, potassium sulfate, cryolite, kyanite, hollow glass beads, ground walnut shells, beads of plastic material or organic compounds (e.g., polytetrafluoroethylene), and foamed glass particles. Porosity forming agents are especially useful in vitreous bond compositions and about 30–60 vol. % porosity forming agent is preferred. A preferred vitreous bond abrasive segment has the composition of about 26 vol. % blocky sol gel alumina particles, about 26 vol. % elongated sol gel alumina filamentary particles, about 10–13 vol. % fused metal oxide mixture and an effective amount of porosity forming agents to yield about 35–38 vol. % porosity. Open cell porous structure is preferred.

The mixture can be cold-compacted at low temperature and high pressure in a preselected mold to form a "green" segment precursor. The term "green" is used to mean that the materials have strength to maintain shape during the next following intermediate process steps but do not have sufficient strength to maintain shape permanently. The green precursors can be cured in a variety of ways to achieve full strength and permanent shape. The curing method and operating conditions therefor depend upon the type of bond materials being used. For example, resinoid bonds can be cured by chemical reaction in the presence of chemical catalysts, additional reactants, radiation and the like. Vitreous and metal bonded segments are often formed by firing at elevated temperature while compressing the precursor. The vitreous and metal bond composition components fuse at the high temperatures then are cooled to embrace the abrasive particles in a strong, rigid uniform matrix.

After the abrasive segments are fabricated they can be attached to the core by various methods known in the art, such as brazing, laser welding, mechanical attachment or gluing with an adhesive or a cement. Great preference is given to cementing the abrasive segments to the core. Naturally, the adhesive should be very strong to withstand the destructive force which is likely to exist during operation, especially in rotary tools, such as grinding wheels. Two-part epoxy resin and "hardener" cement is preferred.

This invention is now illustrated by examples of certain representative embodiments thereof, wherein all parts, proportions and percentages are by weight unless otherwise indicated. All units of weight and measure not originally obtained in SI units have been converted to SI units.

EXAMPLE 1

A 1693 gram abrasive grain mixture of 50% SG grain and 50% TG grain, each having 125 $\mu$m grit size (U.S. No. 120 sieve), obtained from Norton Company, Worcester, Mass., were blended in a motorized mixer for 5–10 minutes with 210 grams of a mixture of vitrified bond components. The bond is described in U.S. Pat. No. 5,401,284 and it includes a major fraction of $SiO_2$, and a minor fraction of each of $Al_2O_3$, $K_2O_3$, $Na_2O$, $Li_2O$ and $B_2O_3$. Animal glue and water in amount of 48 g was included in the composition to provide a uniformly concentrated wetted powder mixture. The mixture was placed into molds to produce curvilinear segments of the type shown in FIG. 1. Dimensions of the segments were 25 mm long, 10 mm wide and 10 mm deep. The molds were cold pressed at 7–14 MPa for about 20–30 seconds to produce "green" segment precursors. The precursors were fired in an air oven at 1000° C. for 8 hours to obtain the completed segments. After firing, the curvature of the segments was well defined and no slumpage was evident.

Twenty-five segments were mounted about the complete circumference of each of three 38:0 cm diameter circular high strength, low alloying steel grinding wheel cores to provide nominally 40 cm diameter wheels. The central bore diameter of these wheels was 12.7 cm. The rim of the steel core was sandblasted to obtain a degree of roughness prior to attachment of the segments. Technodyne® HT-18 (Taoka Chemicals, Japan) epoxy resin and its modified amine hardener was prepared by hand mixing in the ratio of 100 parts resin to 19 parts hardener. Fine silica powder filler was added at a ratio of 3.5 parts per 100 parts resin to increase viscosity. The thickened epoxy cement was then applied to the ends and bottom of segments which were positioned on the core substantially as shown in FIG. 1. Roughening the core improved the effective interfacial area for adhesion of the epoxy. The epoxy cement was allowed to cure at room temperature for 24 hours followed by 48 hours at 60° C. Because the viscosity had been increased, drainage of the epoxy during curing was minimized.

Burst speed testing was done by spin test at acceleration of 45 rev./min. per s. Even though the abrasive segment depth was about 2–3 times that of a typical superabrasive wheel, the test wheels demonstrated burst rating equivalent to 271, 275 and 280 m/s tangential contact speeds. Thus the test wheel would qualify for operation under currently applicable safety standards at 200 m/s and 180 m/s tangential contact speed in Europe and the United States, respectively.

EXAMPLE 2

Three wheels were prepared as in Example 1 except that the core was ANSI 7178 aluminum alloy instead of steel. Burst speeds were 306, 311 and 311 m/s.

EXAMPLE 3

A grinding wheel was prepared as described in Example 2 except that Redux® 420 epoxy and hardener (Ciba-Geigy Polymer Division, France) was used. The adhesive was cured for 4 h at 60° C. Burst speed was 346 m/s.

EXAMPLE 4

A grinding wheel was fabricated as in Example 1 except that the depth of the abrasive segments was increased to 25 mm. Speed at burst was measured in the range of 246–264 m/s which would qualify for operation at tangential contact speed of up to 180 m/s and up to 160 m/s in Europe and the United States, respectively.

EXAMPLES 5–19

Experimental grinding wheels 5–19 (400 mm diameter, 10 mm thickness with 127 mm diameter bore), each having 25 abrasive segments of 10 mm depth, were prepared substantially as described in Example 1. The type of abrasive grain used in each wheel is shown in Table I. The CBN grain had a grit size of 125 $\mu$m. The conventional grains used in examples 5, 7, 12–17 and 19 were 250 $\mu$m grit size (SG) or 180 $\mu$m grit size (TG). All other conventional grain used in these examples had a grit size of 125 $\mu$m. Abrasive grain constituted about 52% of the abrasive segment volume. Each wheels was proof tested at rotation speed equal to 230 m/s tangential contact speed and no segment breakage or steel core yield was observed.

The wheel of Example 6 was tested by plunge grinding a 6.4 mm width of ANSI 52100 or UNS G52986 bearing steel of 60 Rockwell C hardness to a depth of 5.18 mm. The wheel was operated at a tangential contact speeds of 60 n/sec, 90 m/sec, 120 m/sec and 150 m/sec. A Studer CNC S-40 grinding machine with 60 wt % oil, aqueous coolant was used. The maximum power rating of the Studer grinder was 9 kW, thus at the higher speed and higher metal removal rate the wheel pushed the machine near and beyond its design performance specifications.

Results are shown in Table 1. At all metal removal rates, wheel 6 demonstrated significantly better G-ratio, with acceptable power draw, at 150 m/sec relative to 120 m/sec. At the two highest metal removal rates, wheel 6's performance was adversely affected by the grinding machine limitations and even better performance is predicted for the wheel on a machine designed to operate at a higher rate. At all wheel speeds and all metal removal rates little variation in the surface finish was observed and the quality of the surface finish was acceptable. Wheel 6 containing conventional sol gel alumina abrasive was easily dressed by a single row, six diamond point stationary dresser blade during this test.

TABLE 1

Grinding Performance of Wheel 6

| Speed | 150 m/sec | | 120 m/sec | | 90 m/sec | | 60 m/sec | |
|---|---|---|---|---|---|---|---|---|
| Metal Removal Rate $mm^3$/smm | G-ratio | Power W/mm | G-ratio | Power W/mm | G-ratio | Power W/mm | G-ratio | Power W/mm |
| 3.2 | 240.1 | 1140.8 | 74.5 | 772.8 | 88.9 | 496.8 | 58.2 | 346.5 |
| 6.4 | 157.0 | 1269.6 | 68.5 | 858.7 | 68.1 | 570.4 | 54.2 | 435.5 |
| 9.6 | 136.6 | 1159.2 | 54.7 | 895.5 | 63.2 | 619.5 | 49.9 | 484.5 |
| 12.8 | 139.3 | 1288.0 | 53.8 | 870.9 | 61.1 | 650.1 | 49.5 | 548.9 |
| 16.0 | 78.2 | 1508.8 | 47.8 | 950.7 | 52.8 | 748.3 | 48.6 | 628.7 |
| 19.3 | n/a* | n/a* | 40.2 | 1030.4 | 49.8 | 809.6 | 47.2 | 674.7 |

*The grinding machine had insufficient power to operate at this MRR and wheel speed.

Another grinding test was conducted under the same conditions (except a 3.2 mm width of cut was made on the workpiece) in order to compare the grinding performance of wheels of Examples 5–19. In this test, commercially acceptable G-ratios, power draw and surface finish quality were observed for all wheels. Results are shown in Table 2.

Attempts to grind a 3.2 mm width of cut on the workpiece under these conditions at a 150 m/sec wheel speed using a commercial vitrified bonded CBN control wheel resulted in wheel breakage. This made it impossible to directly compare superabrasive wheels to the wheels of the invention at the speed of 150 m/sec. These commercial CBN wheels (same shape as the experimental wheels, with abrasive segments 5 mm in depth, containing 36 vol. % 125 $\mu$m grit CBN and 20 vol. % bond) could only be tested at a tangential contact speed of 120 m/sec. The CBN wheel displayed a maximum metal removal rate of 122 $mm^3$/s.mm at 120 m/sec.

Examples 5 and 6 contain no superabrasive grain. The grain used was a blend of conventional abrasive grains of sol gel alumina. These wheels were able to deliver a maximum metal removal rate of 148 $mm^3$/s.mm, about 21% greater than the commercial CBN wheels which could only be operated at 120 m/sec. All of the conventional abrasive and conventional abrasive/CBN wheels were easily dressed by a single row, six diamond point stationary dresser blade. In contrast, the commercial CBN wheels required dressing by a rotary dresser. The superabrasive wheels also produced significant amounts of chipping and loading which was not seen in the wheels with conventional abrasives.

The difficulties in dressing superabrasive wheels to open the face of the wheel and to correct the dimension of the wheel (true the wheel, typically before initial use and during grinding operations, as needed) are well-known to the industry and a serious deterrent to use of superabrasive wheels, particularly CBN wheels, in spite of their demonstrated superiority in many high speed grinding operations. None of these difficulties were observed with the wheels of the invention.

Based on these data, maximum metal removal rates, G-ratios and other grinding performance parameters of the wheels of the invention are projected to be equivalent to those of commercial CBN wheels when operated at the higher speeds (i.e., at least 125 m/sec) designated for operating the wheels of the invention. Although the CBN wheels are observed to have higher G-ratios than the wheels of the invention when operated at speeds of 120 m/sec or less, the ease of dressing observed for the wheels of the invention, in combination with significant abrasive grain cost savings, permit commercial operations to utilize wheels having deeper abrasive segments and containing more abrasive grain. The greater segment depth possible with the wheels of the invention will compensate for observed lower G-ratios at lower metal removal rates to yield results equivalent to commercial superabrasive wheels over the lives of both types of wheels.

Test results for the wheels of Examples 7–19 demonstrate that operation at tangential contact speed above 125 m/s according to the present invention offers the ability to substantially replace or dilute superabrasive with much less costly conventional abrasive grain and obtain acceptable grinding performance to replace a superabrasive tools.

EXAMPLE 20

A wheel containing an unseeded sol gel alumina abrasive grain (321 grain made by 3M Corporation, Minneapolis, Minn.) was prepared in the same manner as Example 6, except that no TG alumina grain was used. In a grinding test under the same conditions used above (grinding a 3.2 mm width cut on the workpiece), the unseeded sol gel alumina grain wheel displayed grinding performance at least equivalent to wheels 6 at 120 m/sec and 150 m/sec, and compared favorably to the commercial CBN wheel at 120 m/sec. Thus, unseeded, as well as seeded and filamentary, polycrystalline sintered sol gel alpha-alumina grain is preferred for use in the wheels of the invention.

Although specific forms of the invention have been selected for illustration in the drawings and examples, and the preceding description is drawn in specific terms for the purpose of describing these forms of the invention, this description is not intended to limit the scope of the invention which is defined in the claims.

TABLE 2

| | | | Grinding Performance at 150 m/sec | | | | |
|---|---|---|---|---|---|---|---|
| Abrasive Wheel | Abrasive vol. %-Type[1] | Bond (vol. %) | Max. Metal Removal Rate ($mm^3$/smm) | Grinding Power (kW) | Average G-Ratio ($mm^3/mm^3$) | No. Cuts for G-Ratio | Dressing Operation |
| Ex. 5 | 26-TG<br>26-SG | 10 | 148 | 11.5 | 399 | 9 | Stationary Diamond Blade/easy |
| Ex. 6 | 26-TG<br>26-SG | 13 | 148 | 12 | 452 | 9 | Stationary Diamond Blade/easy |
| Ex. 7 | 26-TG<br>16-SG<br>10-CBN | 10 | 148 | 9 | 307 | 9 | Stationary Diamond Blade/OK |
| Ex. 8 | 26-TG<br>16-SG<br>10-CBN | 10 | 161 | 10 | 332 | 3 | Stationary Diamond Blade/OK |
| Ex. 9 | 26-TG<br>16-SG<br>10-CBN | 13 | 148 | 8 | 228 | 9 | Stationary Diamond Blade/OK |
| Ex. 10 | 26-TG<br>16-SG<br>10-CBN | 13 | 168 | 10 | 457 | 3 | Stationary Diamond Blade/OK |
| Ex. 11 | 26-TG<br>16-SG<br>10-CBN | 13 | 174 | 9.7 | 457 | 3 | Stationary Diamond Blade/OK |
| Ex. 12 | 26-TG<br>16-SG<br>10-CBN | 13 | 148 | 9 | 362 | 9 | Stationary Diamond Blade/OK |
| Ex. 13 | 26-TG<br>16-SG<br>10-CBN | 13 | 161 | 9 | 443 | 3 | Stationary Diamond Blade/OK |
| Ex. 14 | 26-TG<br>16-SG | 13 | 168 | 11.5 | 443 | 3 | Stationary Diamond |

TABLE 2-continued

| Abrasive Wheel | Abrasive vol. %-Type[1] | Bond (vol. %) | Max. Metal Removal Rate ($mm^3$/smm) | Grinding Power (kW) | Average G-Ratio ($mm^3/mm^3$) | No. Cuts for G-Ratio | Dressing Operation |
|---|---|---|---|---|---|---|---|
| | Grinding Performance at 150 m/sec | | | | | | |
| Ex. 15 | 10-CBN<br>26-TG<br>16-SG<br>10-CBN | 8 | 148 | 7.6 | 166 | 3 | Blade/OK<br>Stationary<br>Diamond<br>Blade/OK<br>At high<br>MMR corner<br>breakdown |
| Ex. 16 | 26-TG<br>16-SG<br>10-CBN | 8 | 168 | 7.6 | 166 | 3 | Stationary<br>Diamond<br>Blade/OK<br>At high<br>MMR corner<br>breakdown |
| Ex. 17 | 26-TG<br>16-SG<br>10-CBN | 8 | 187 | 9.1 | 221 | 3 | Stationary<br>Diamond<br>Blade/OK<br>At high<br>MMR corner<br>breakdown |
| Ex. 18 | 26-TG<br>16-SG<br>10-CBN | 9 | 103 | 6.9 | 443 | 3 | Stationary<br>Diamond<br>Blade/OK<br>At high<br>MMR corner<br>breakdown |
| Ex. 19 | 26-TG<br>16-SG<br>10-CBN | 9 | 122 | 5.8 | — | — | Stationary<br>Diamond<br>Blade/OK<br>At high<br>MMR corner<br>breakdown |
| Control | 36-CBN | 20 | 122 | 8.2 | wheel broke | — | Rotary Dresser<br>At high MRR<br>wheel face loads<br>& chips |

What is claimed is:

1. A method of grinding a work piece comprising:

providing a grinding tool consisting essentially of a core having a core strength parameter of at least about 60 MPa-$cm^3$/g;

an abrasive segment affixed to the circumference of the core, wherein the abrasive segment comprises conventional abrasive non-superabrasive grains embedded in a bond, the abrasive segment having a rim strength parameter of at least about 10 MPa-$cm^3$/g; and a means for adhering the abrasive segment to the core; and moving the abrasive segment at a tangential contact speed of at least about 125 m/sec in contact with the work piece.

2. The invention of claim 1 wherein the conventional abrasive is polycrystalline alpha-alumina grain made by a sol gel process.

3. The invention of claim 2 wherein the polycrystalline alpha-alumina grain is made by a seeded sol gel process.

4. The invention of claim 3 wherein a portion of the polycrystalline alpha-alumina grain is in the form of elongated particles having an aspect ratio of at least about 3: 1.

5. The invention of claim 4 wherein the polycrystalline alpha-alumina grain consists essentially of equal portions of (a) elongated particles having a aspect ratio of at least 3:1 and (b) blocky particles.

6. The invention of claim 1 wherein the abrasive segment further comprises superabrasive grain in the bond and the superabrasive grain constitutes a minor fraction of the grains in the abrasive segment.

7. The invention of claim 1 wherein the core is of a durable material selected from the group consisting of metal, metal composite, metal alloy, engineering plastic, fiber reinforced plastic and plastic composite, and combinations thereof.

8. The invention of claim 7 wherein the durable material is metal.

9. The invention of claim 8 wherein the durable material comprises steel, aluminum or titanium.

10. The invention of claim 8 wherein the abrasive segment is a continuous rim cemented to the core.

11. The invention of claim 7 wherein the abrasive segment includes at least one abrasive segment cemented to the core.

12. The invention of claim 11 wherein the abrasive segment is defined by a depth of at least about 10 mm and wherein the wheel has a burst speed of greater than about 270 m/s.

13. The invention of claim 12 wherein the abrasive segment is defined by a depth of at least about 25 mm and wherein the wheel has a minimum burst speed of greater than 245 m/s.

14. The invention of claim 13 wherein the tangential contact speed is about 150 m/s to about 180 m/s.

15. The invention of claim 11 wherein the tangential contact speed is about 150 m/s to about 200 m/s.

16. The invention of claim 1 wherein the bond is a vitrified bond having a firing temperature no greater than 1100° C.

17. A method of making an abrasive wheel comprising:

blending grains of a conventional abrasive with a vitrified bond composition to obtain a uniform mixture;

shaping the mixture to form an abrasive segment preform;

firing the preform for a time and at a temperature effective to fix the abrasive grains in the bond with a rim strength parameter of at least about 60 MPa-$cm^3$/g, thereby obtaining an abrasive segment; and attaching the abrasive segment with a cement to a core having a core strength parameter of at least about 10 MPa-$cm^3$/g, wherein the cement has thermal stability and adhesive strength effective to withstand grinding of a work piece at a tangential contact speed of greater than 125 m/s.

18. The invention of claim 17 wherein the firing temperature is at most 1100° C.

19. The invention of claim 17 wherein the conventional abrasive includes sol gel alumina abrasive grain.

* * * * *

UNITED STATES PATENT AND TRADEMARK OFFICE

CERTIFICATE OF CORRECTION

PATENT NO. : 6,074,278
APPLICATION NO. : 09/016823
DATED : June 13, 2000
INVENTOR(S) : Mianxue Wu, Lee A. Carman and Lars Aspensjö

It is certified that error appears in the above-identified patent and that said Letters Patent is hereby corrected as shown below:

In claim 17, column 15, line 7, delete the number "60" and insert in place thereof --10--.

In claim 17, column 15, line 10, delete the number "10" and insert in place thereof --60--.

Signed and Sealed this

Fifth Day of June, 2007

JON W. DUDAS
*Director of the United States Patent and Trademark Office*